United States Patent [19]

Leslie

[11] Patent Number: 4,721,237

[45] Date of Patent: Jan. 26, 1988

[54] PORTABLE COOLER FOR A NUMBER OF BEVERAGE CANS

[76] Inventor: Peter C. Leslie, 201 A St., Wilmington, Del. 19801

[21] Appl. No.: 926,343

[22] Filed: Nov. 3, 1986

[51] Int. Cl.[4] ..... A45F 3/20

[52] U.S. Cl. ..... 224/148; 224/151; 224/153; 224/210; 150/52 R; 62/371; 206/170; 206/199; 206/428; 206/499; 206/523; 221/64; 221/308

[58] Field of Search ..... 224/148, 151, 153, 210; 150/522; 206/170, 199, 499, 428, 523; 62/371, 372; 221/306, 307, 308, 309, 64

[56] References Cited

U.S. PATENT DOCUMENTS 2,576,874 11/1951 Action ..... 221/150
3,287,073 11/1966 Holtkamp ..... 221/150
4,194,647 8/1980 Spurrier ..... 221/313
4,375,828 3/1983 Biddison ..... 150/52 R

*Primary Examiner*—Houston S. Bell, Jr.
*Attorney, Agent, or Firm*—Norman B. Rainer

[57] ABSTRACT

A portable cooler which may be carried in back-pack style is adapted to store and automatically dispense a number of cans of beverage. The cooler is comprised of a box-like chamber having self-supporting thermally insulative material on its exterior surfaces. One or more removable coolant-confining containers are positioned within the chamber, each container having a serpentine contour of horizontally elongated recesses adapted to hold beverage cans and permit their vertical descent to a door positioned adjacent the bottom of the chamber. The chamber is held within a snug-fitting fabric carrying jacket having a zippered lid and closure for the door, and carrying straps.

13 Claims, 7 Drawing Figures

PORTABLE COOLER FOR A NUMBER OF BEVERAGE CANS

BACKGROUND OF THE INVENTION

This invention relates to a portable cooler apparatus, and more particularly concerns a cooler of back-pack style for storing and dispensing a number of cans of beverage.

Various thermally insulated cooler chests have earlier been disclosed for confining a number of cans of beverage in close adjacency to cooling means while additionally providing means for facile removal of said cans. For example, a cooler chest described n U.S. Pat. No. 4,194,647 to Spurrier is comprised of a box-like insulated chest having dispenser means for causing substantially automatic gravity feed of cans to an access door, said cans being cooled by "ice particles" placed in direct contact therewith. Although presumably of a portable nature, the horizontal format of the Spurrier chest and its cumbersome construction appear to preclude carrying by one person in back-pack manner. Also, the requisite ice particles are not readily available and may cause malfunction of the dispensing mechanism.

A back-pack type of thermally insulative carrier adapted for use by campers is disclosed in U.S. Pat. No. 4,513,895 to Leslie. However said back-pack cooler makes no provision for the automatic gravity-feed dispensation of beverage cans, and is not specially interactive with any particular cooling means.

A portable cooler chest is disclosed in U.S. Pat. No. 4,441,336 which encloses a removable ice-confining container whose exterior shape has cavities which accommodate beverage cans for efficient cooling thereof. Although such construction eliminates leakage of coolant substance and facilitates removal of beverage cans in the direction of their center axis, the design does not permit automatic dispensation of the cans.

It is accordingly an object of the present invention to provide a cooler for storing and dispensing a number of cans of beverage.

It is another object of this invention to provide a cooler as in the foregoing object which may be carried by one person in back-pack style.

It is a further object of the present invention to provide a cooler of the aforesaid nature having efficient, non-leaking cooling means which interactively enhances said dispensing feature.

It is still another object of this invention to provide a cooler of the aforesaid nature of rugged and durable construction which may be economically manufactured.

These objects and other objects and advantages of the invention will be apparent from the following description.

SUMMARY OF THE INVENTION

The above and other beneficial objects and advantages are accomplished in accordance with the present invention by a portable cooler apparatus comprising:

(a) a box-like chamber of monolithic construction having forward and rear and opposed side vertical wall panels arranged in a substantially rectangular configuration and a bottom panel, said panels having interior and exterior surfaces, said forward wall panel having an access aperture located adjacent said bottom panel, (b) self-supporting thermally insulative material disposed upon the exterior surfaces of said panels, (c) a coolant-confining container removably insertable into said chamber and positioned by the interior surfaces of said panels, said container having a series of parallel recesses of semi-circular horizontally elongated cylindric contour adapted to hold beverage cans in vertically descendable disposition, and further having a closable port for the entrance or egress of coolant substance, (d) door means associated with said access aperture, and (e) a carrying jacket of fabric construction which snugly fits about said chamber and having lid means to close said chamber, carrying straps, and closure means associated with said door means.

In preferred embodiments of the invention, the chamber is fabricated of a thermoplastic polymer which provides semi-flexible wall panels. The interior surfaces of the opposed side panels may have a serpentine contour adapted to interact with the cans and coolant container. The thermally insulative material is preferably a closed cell polymer foam in the form of sheet or slab stock adhered to the exterior surfaces of the chamber panels. The coolant container preferably has a size permitting accommodation by a household freezer, and may be provided with external structure interactive with either other adjacent coolant containers or the interior surfaces of the chamber wall panels to cause sufficiently precise positioning within the chamber to permit automatic dispensation of cans. The door means is preferably a horizontally hinged flap-like structure adapted to swing outwardly from the chamber. The fabric of said carrying jacket is preferably comprised of strong synthetic fiber having sewn seams and provided with zippers defining a lid portion and closure means. The lid portion preferably carries a rectangular piece of said insulative material adapted to make sealing engagement with the otherwise open upper extremity of said chamber. The jacket may further contain exterior storage pockets.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
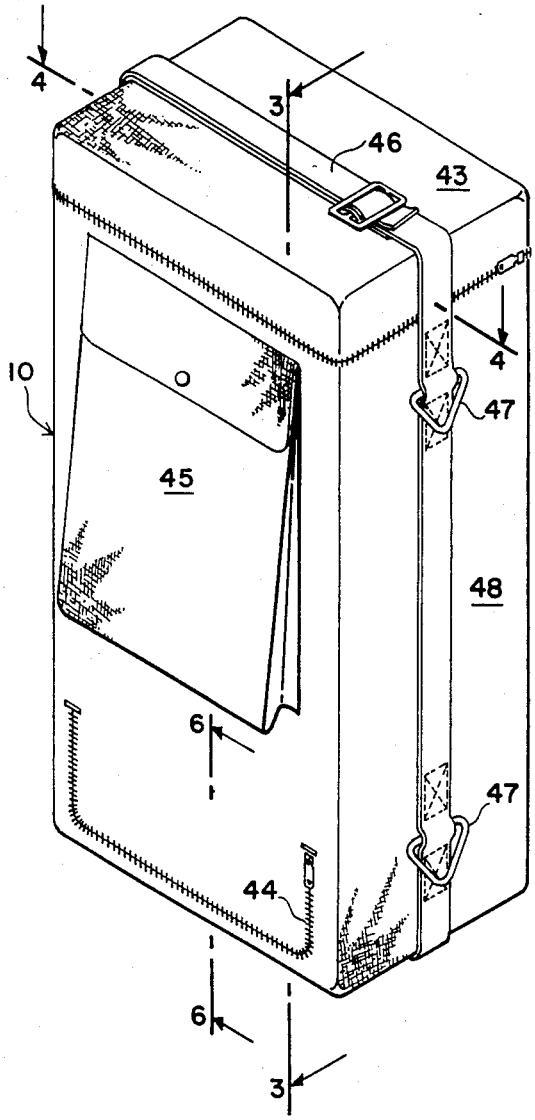
FIG. 1 is a front perspective view of an embodiment of the cooler of this invention.
Figure 2:
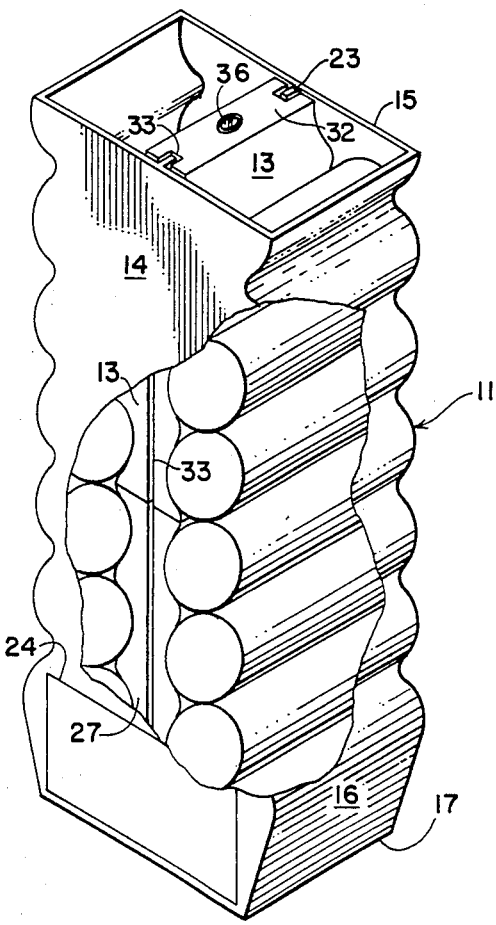
FIG. 2 is a front perspective view of the cooler of FIG. 1 with the insulative material and carrying jacket removed for better visualization of internal details.

Referring to FIGS. 1–4, an embodiment of the cooler apparatus is shown comprised of a carrying jacket 10, chamber 11 contained within said jacket, insulative material 12 disposed about the exterior of chamber 11, and upper and lower coolant-confining containers 13 and 27, respectively, positioned within the chamber.

Chamber 11 is of box-like configuration, having forward and rear wall panels 14 and 15, respectively, and opposed side wall panels 16, said four wall panels being vertically arranged in a substantially rectangular configuration, and bottom panel 17. The several panels of the chamber are integral portions of a monolithic structure as may be fabricated by rotational or blow molding techniques using impact-resistant thermoplastic resins such as acrylonitrile-butadiene-styrene interpolymers. The panels are of a semi-flexible nature, having a thickness in the range of about 20–100 mils, and may be further characterized as having interior and exterior surfaces 18 and 19, respectively.

Figure 3:
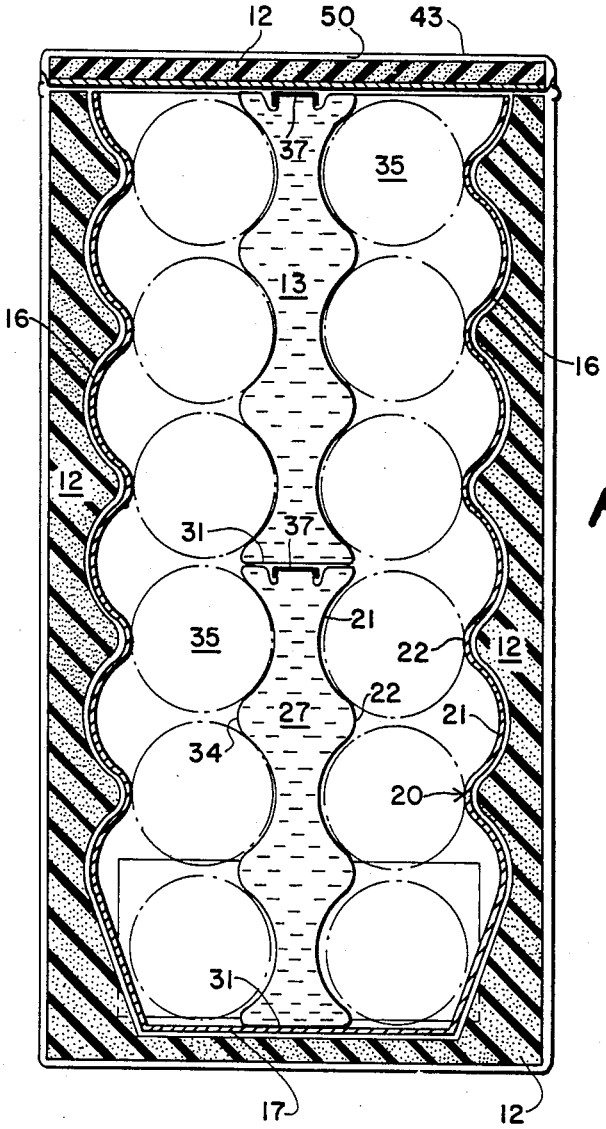
FIG. 3 is an enlarged sectional side view taken along the line 3—3 of FIG. 1.
Figure 4:
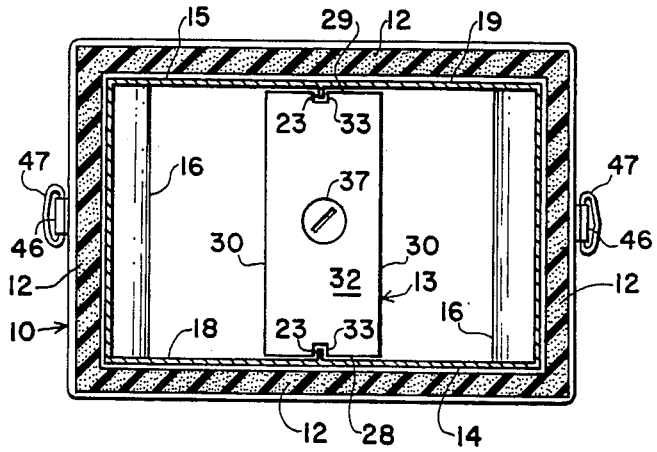
FIG. 4 is an enlarged sectional view taken along the line 4—4 of FIG. 1.

The interior surfaces of the side wall panels 16 of the embodiment of chamber 11 exemplified in FIGS. 1–6 have a serpentine contour 20, as best shown in FIG. 3. The serpentine contour is comprised of a series of parallel recesses 21 of semi-circular horizontally elongated cylindric shape joined by intervening rounded peaks 22. The interior surfaces of the forward and rear panels are provided with a ridge 23 which traverses the height of the panel at the center thereof, said ridges being for the purpose of engaging the coolant containers, as will hereinafter be shown. An access aperture 24 of rectangular perimeter is located in forward panel 14 adjacent bottom panel 17.

The thermally insulative material 12 is in the form of self-supporting closed cell foam fabricated of polymers such as polyethylene, polystyrene, and rigid polyurethane. The foam may have a thickness in the range of about ½" and 1", and is preferably adhered to the exterior surfaces of the panels of the chamber. Alternatively, the insulative material may be associated with the exterior surfaces by having been deposited from fluid polymer upon said surfaces, whereby self-adhesion occurs. One such technique is known as "foam-in-place."

Upper and lower coolant-confining containers 13 and 27, respectively, are disposed within chamber 11 of the embodiment of FIGS. 1–6. Said containers are monolithic structures fabricated of thermoplastic material and comprised of front and back panels, 28 and 29, respectively, opposed side panels 30, flat lower panel 31, and flat roof panel 32. Said front and back panels are provided with track-like depressions 33 adapted to slidably engage ridges 23 of the forward and rear panels of the chamber so that lower panel 31 of container 27 will seat upon bottom panel 17 of the chamber, and container 13 will seat upon container 27. Side panels 30 have a serpentine contour 34 substantially identical to the serpentine contour 20 of the side panels of the chamber but in opposite relationship thereto and, in the seated position of the containers, out of register therewith so that the peaks of one contour are directed horizontally toward the centers of the recesses 21 of the opposing contour. By virtue of such construction, beverage cans 35 are caused to fit between the recesses and peaks of opposing contours, and are able to roll downwardly therebetween. It is to be further noted that the distance of horizontal separation between opposing contours must be matched to the diameter of the beverage cans. Because of the track positioning of the containers, they will retain their positions even when the cans have been removed from the chamber.

The roof panel 32 of each container is provided with a port 36 capable of receiving water or ice cubes. Said port is sealed by a threaded closure cap 37, preferably flush-fitting with roof panel 32. The roof panel of lower container 27 and the lower panel of upper container 13 are provided with interactive engaging means of conventional design (not shown) such as a rotary bayonet-type socket mount. The purpose of such engaging means is to further stabilize the positions of the containers.

Figure 7:
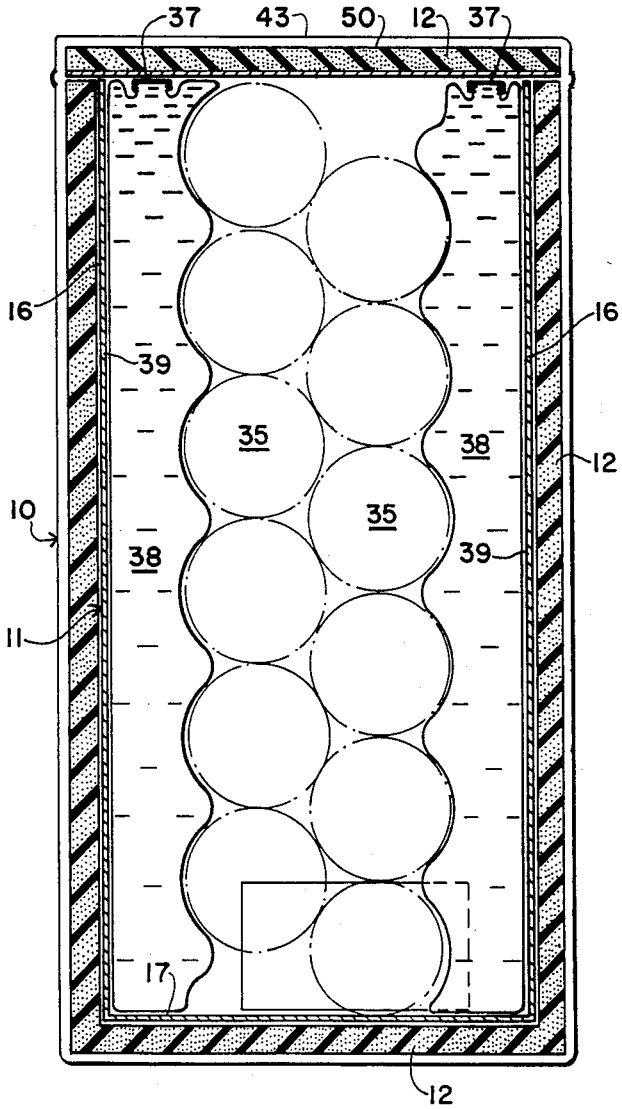
FIG. 7 is a sectional side view of an alternative embodiment of the cooler of the present invention.

The containers 38 of the embodiment of FIG. 7, having facing surfaces of serpentine contour, are placed against side panels of a chamber having flat interior surfaces 39. In said embodiment, a doubled stack of cans 35 is disposed between said facing serpentine surfaces in a manner to permit alternating downward rolling movement.

Figure 5:
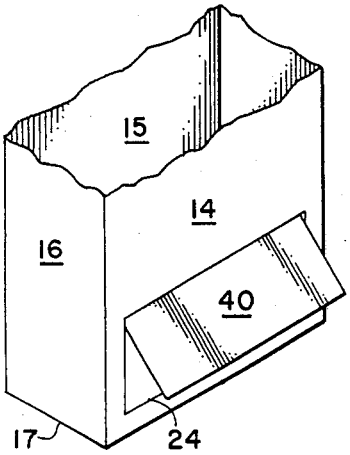
FIG. 5 is a fragmentary perspective view of the lower portion of the chamber showing the door structure.
Figure 6:
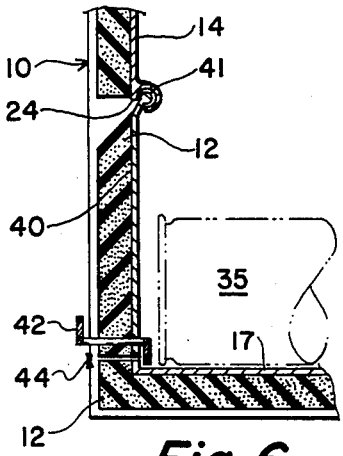
FIG. 6 is an enlarged fragmentary view taken along the line 6—6 of FIG. 1.

As shown most clearly in FIGS. 5 and 6, a door 40, adapted to be lifted upwardly away from the chamber, is attached by horizontally disposed pivot means 41 to forward panel 14 in a manner to cover access aperture 24. Locking means 42 are associated with the lowermost extremity of the door to assure tight-fitting closure against panel 14.

Carrying jacket 10 is provided with a zippered lid portion 43 containing a pocket 50 which receives a rectangular piece of insulative material 12 adapted to fit within or upon the upwardly directed open extremity of chamber 11. Similarly, said jacket contains a flap-like zippered portion 44 which permits access to door 40 and contains a pocket adapted to carry a piece of insulative material 12. An optional auxiliary pocket 45 is positioned upon the forward face of said jacket, namely the portion disposed upon the forward panel of the chamber. A carrying strap 46 of adjustable length is attached by sewing to the side wall portions 48 of the jacket, said sewn portions serving further to anchor D-rings 47. Said carrying strap permits hand carrying of the cooler. The D-rings further facilitate attachment to the jacket of other straps which permit the cooler to be carried as a back pack whereby the rear wall panel 15 of the chamber rests upon the wearer's back.

In operation, a coolant, preferably water, is entered into the containers which are then placed in a freezer. Alternatively, ice may be introduced into the containers, thereby permitting immediate use, or permitting use when a freezer is unavailable. The ice-containing containers are then properly positioned within the chamber along with beverage cans. When a can is removed from the access aperture, subsequent cans will roll downwardly to said access aperture.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A portable cooler apparatus for a number of beverage cans comprising:

(a) a box-like chamber of monolithic construction having forward, rear and opposed side wall panels arranged in a substantially rectangular configuration and a bottom panel perpendicularly joined to the lowermost extremities of said wall panels, said panels having interior and exterior surfaces, and said forward wall panel having an access aperture located adjacent said bottom panel, (b) self-supporting thermally insulative material disposed upon the exterior surfaces of said panels, (c) a coolant-confining container removably insertable into said chamber and positioned by the interior surfaces of said panels, said container having a serpentine contour comprising a series of parallel recesses of horizontally elongated substantially semi-circular cylindric shape joined by intervening peaks and adapted to hold beverage cans in vertically descendable disposition, and further having a closable port for the entrance or egress of coolant substance, (d) door means associated with said access aperture, and (e) a carrying jacket of fabric construction which snugly fits about said chamber and having lid means to close said chamber, carrying straps, and closure means associated with said door means.

2. The apparatus of claim 1 wherein said chamber is fabricated of a thermoplastic polymer which provides semi-flexible wall panels.

3. The apparatus of claim 2 wherein the interior surfaces of said opposed side panels have a serpentine contour adapted to accommodate said beverage cans.

4. The apparatus of claim 3 wherein the serpentine contour of the opposed side panels faces the serpentine contour of said coolant-confining container.

5. The apparatus of claim 4 wherein the facing serpentine contours of said side walls and coolant-confining container are identical and arranged so that the peaks of one contour are directed horizontally toward the centers of the recesses of the facing contour.

6. The apparatus of claim 5 wherein the spacing between the facing serpentine contours is uniform and substantially equal to the diameter of said cans.

7. The apparatus of claim 2 wherein the thermally insulative material is a closed cell polymer foam.

8. The apparatus of claim 7 wherein said door means is horizontally hinged and adapted to swing outwardly from said chamber.

9. The apparatus of claim 1 wherein said jacket is provided with zippers defining said lid means and closure means.

10. The apparatus of claim 9 wherein said lid means carries a rectangular piece of said insulative material in a manner adapted to make sealing engagement with the otherwise open upper extremity of said chamber.

11. The apparatus of claim 8 wherein two coolant-confining containers are centrally positioned one atop the other within said chamber, the lowermost container being seated upon said bottom panel.

12. The apparatus of claim 11 wherein said coolant-confining containers are provided with positioning means slidably interactive with said forward and rear wall panels.

13. The apparatus of claim 12 wherein said coolant-confining containers are comprised of opposed side panels, each having a serpentine contour.

* * * * *